US010974119B1

(12) United States Patent
Julian

(10) Patent No.: US 10,974,119 B1
(45) Date of Patent: Apr. 13, 2021

(54) PUNCHING BAG SLING WITH COVER

(71) Applicant: David Julian, Rialto, CA (US)

(72) Inventor: David Julian, Rialto, CA (US)

( * ) Notice: Subject to any disclaimer, the term of this patent is extended or adjusted under 35 U.S.C. 154(b) by 0 days.

(21) Appl. No.: 16/674,045

(22) Filed: Nov. 5, 2019

(51) Int. Cl.
*A63B 69/20* (2006.01)
*A63B 71/00* (2006.01)

(52) U.S. Cl.
CPC ..... *A63B 69/201* (2013.01); *A63B 69/20* (2013.01); *A63B 2071/009* (2013.01)

(58) Field of Classification Search
CPC ..... A63B 69/201; A63B 69/20; A63B 69/203; A63B 69/205; A63B 69/24; A63B 69/34; A63B 69/345; A63B 7/00; A63B 21/0004; A63B 21/00189; A63B 2071/009; A63B 37/12; A63B 39/06; A63B 41/08; A63B 2244/102; A63B 2244/104; A63B 2244/106
See application file for complete search history.

(56) References Cited

U.S. PATENT DOCUMENTS 5,263,912 A * 11/1993 Stelmach ..... A63B 69/004 473/442
6,234,940 B1 5/2001 Fotsis
6,302,831 B1 * 10/2001 Henry ..... A63B 69/004 482/83
6,726,605 B2 4/2004 Chen
7,909,749 B2 3/2011 Sheedy
8,652,014 B2 2/2014 Smith
8,894,552 B2 * 11/2014 Wilson ..... A63B 69/20 482/83
D792,531 S 7/2017 Bossier
2002/0115538 A1 * 8/2002 Wen ..... A63B 69/34 482/83
2007/0099772 A1 * 5/2007 Fu ..... A63B 69/004 482/83
2008/0096733 A1 * 4/2008 Epstein ..... A63B 69/201 482/83
2013/0072358 A1 3/2013 Martinez

FOREIGN PATENT DOCUMENTS

WO 2012089194 7/2012

* cited by examiner

*Primary Examiner* — Megan Anderson
(74) *Attorney, Agent, or Firm* — Kyle A. Fletcher, Esq.

(57) ABSTRACT

The punching bag sling with cover is configured for use with a punching bag. The punching bag sling with cover is a mechanical structure. The punching bag sling with cover suspends the punching bag above a supporting surface. The punching bag sling with cover forms a sheath that encloses the punching bag. The punching bag sling with cover comprises a sling, a bag sheath, a plurality of anchor structures, a plurality of chains and a suspension ring. The plurality of chains attach the suspension ring to the plurality of anchor structures. The plurality of anchor structures attach the plurality of chains to the sling. The bag sheath forms the cover that encloses the punching bag. The suspension ring forms an anchor point that suspends the punching bag sling with cover and the punching bag above the supporting surface.

19 Claims, 7 Drawing Sheets

PUNCHING BAG SLING WITH COVER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of physical training apparatus including training apparatus for special sports, more specifically, an apparatus configured for use with a training dummy further configured for use in boxing. (A63B69/34)

SUMMARY OF INVENTION

The punching bag sling with cover is configured for use with a punching bag. The punching bag sling with cover is a mechanical structure. The punching bag sling with cover suspends the punching bag above a supporting surface. The punching bag sling with cover forms a sheath that encloses the punching bag. The punching bag sling with cover comprises a sling, a bag sheath, a plurality of anchor structures, a plurality of chains and a suspension ring. The plurality of chains attach the suspension ring to the plurality of anchor structures. The plurality of anchor structures attach the plurality of chains to the sling. The bag sheath forms the cover that encloses the punching bag. The suspension ring forms an anchor point that suspends the punching bag sling with cover and the punching bag above the supporting surface. The bag sheath may be in the form of a cylinder with a top opening and a bottom opening such that the bottom opening is sealed closed when in use.

These together with additional objects, features and advantages of the punching bag sling with cover will be readily apparent to those of ordinary skill in the art upon reading the following detailed description of the presently preferred, but nonetheless illustrative, embodiments when taken in conjunction with the accompanying drawings.

In this respect, before explaining the current embodiments of the punching bag sling with cover in detail, it is to be understood that the punching bag sling with cover is not limited in its applications to the details of construction and arrangements of the components set forth in the following description or illustration. Those skilled in the art will appreciate that the concept of this disclosure may be readily utilized as a basis for the design of other structures, methods and systems for carrying out the several purposes of the punching bag sling with cover.

It is therefore important that the claims be regarded as including such equivalent construction insofar as they do not depart from the spirit and scope of the punching bag sling with cover. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
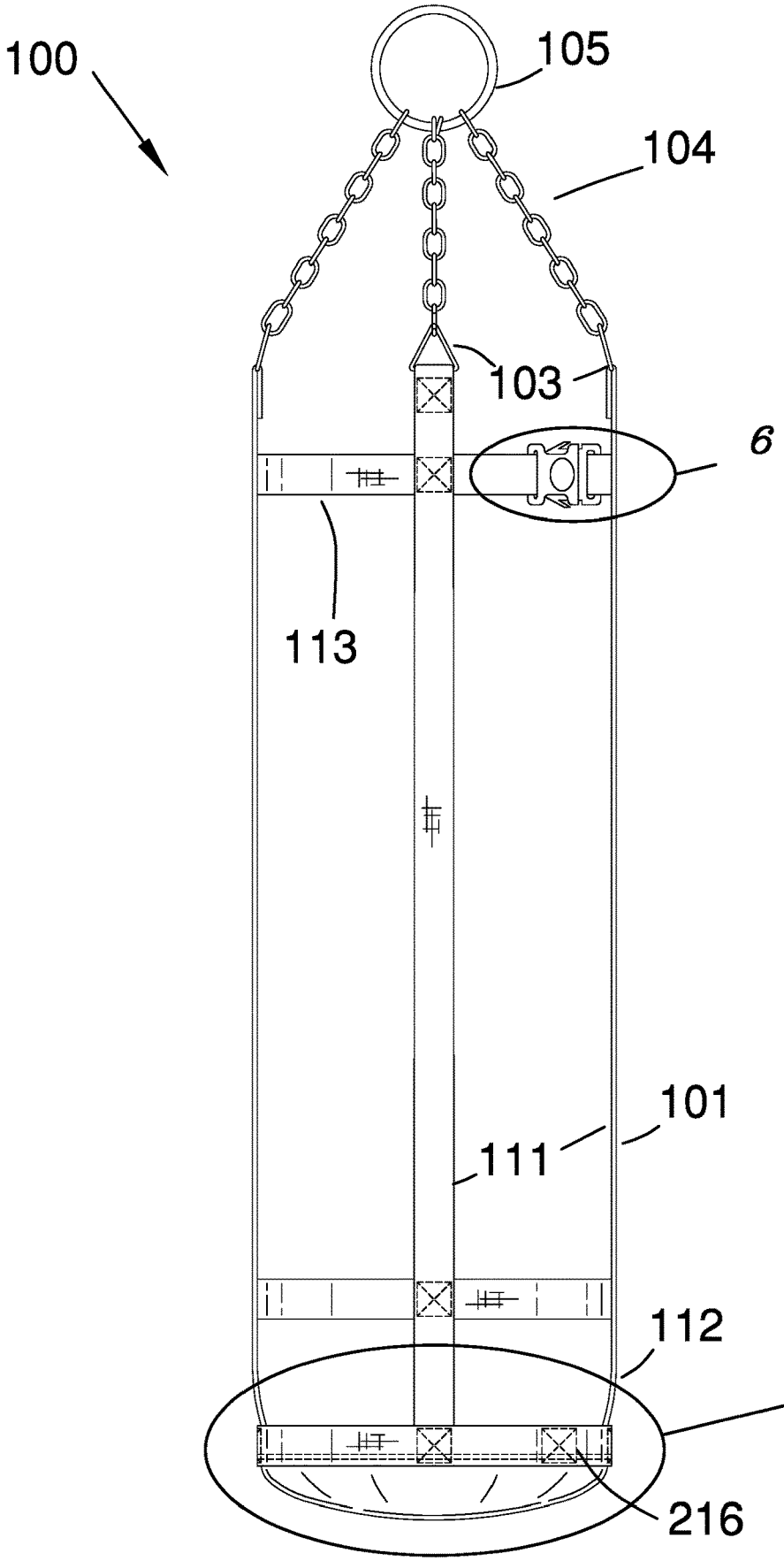
FIG. 1 is a front view of an embodiment of the disclosure.
Figure 2:
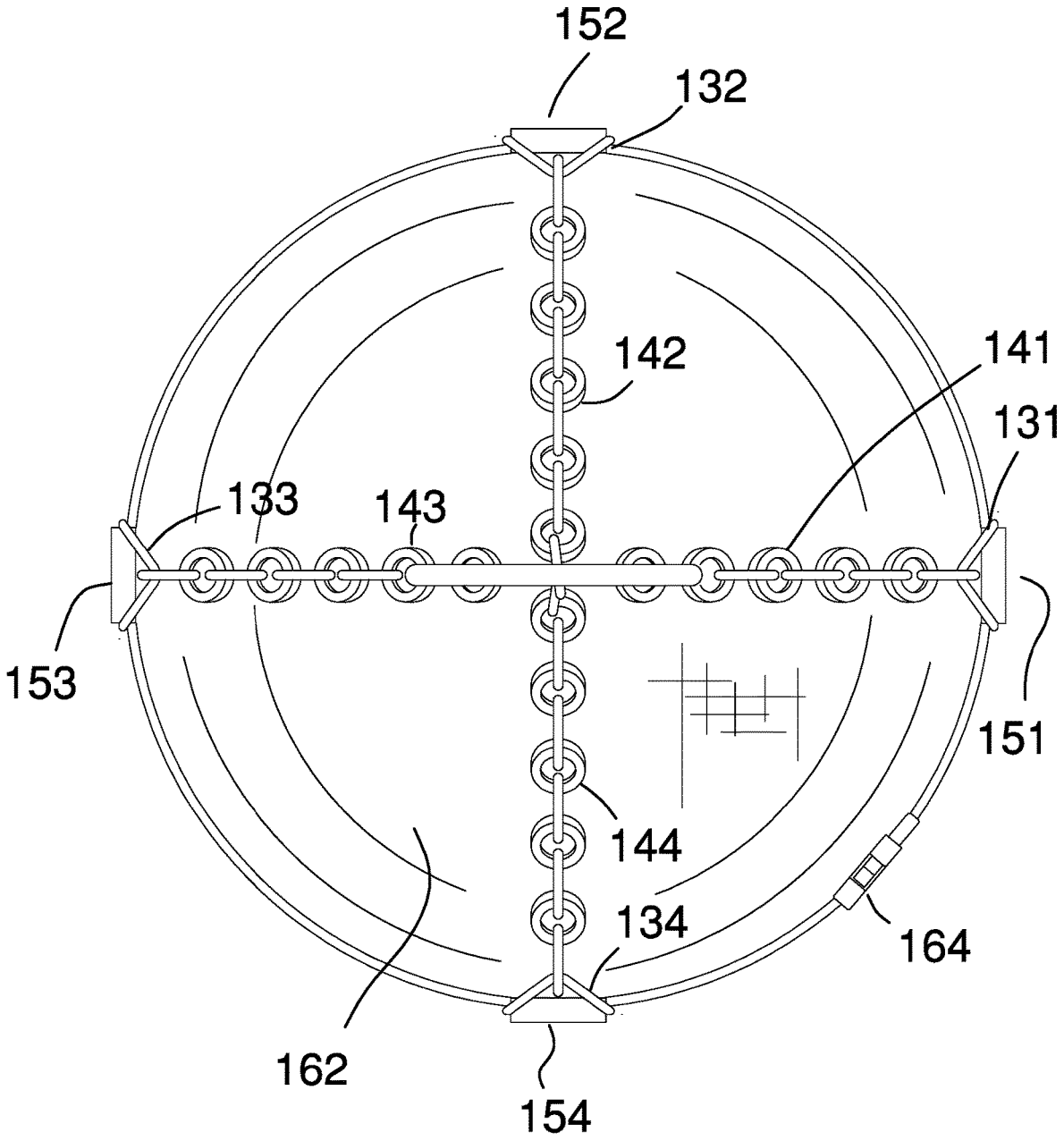
FIG. 2 is a top view of an embodiment of the disclosure.
Figure 3:
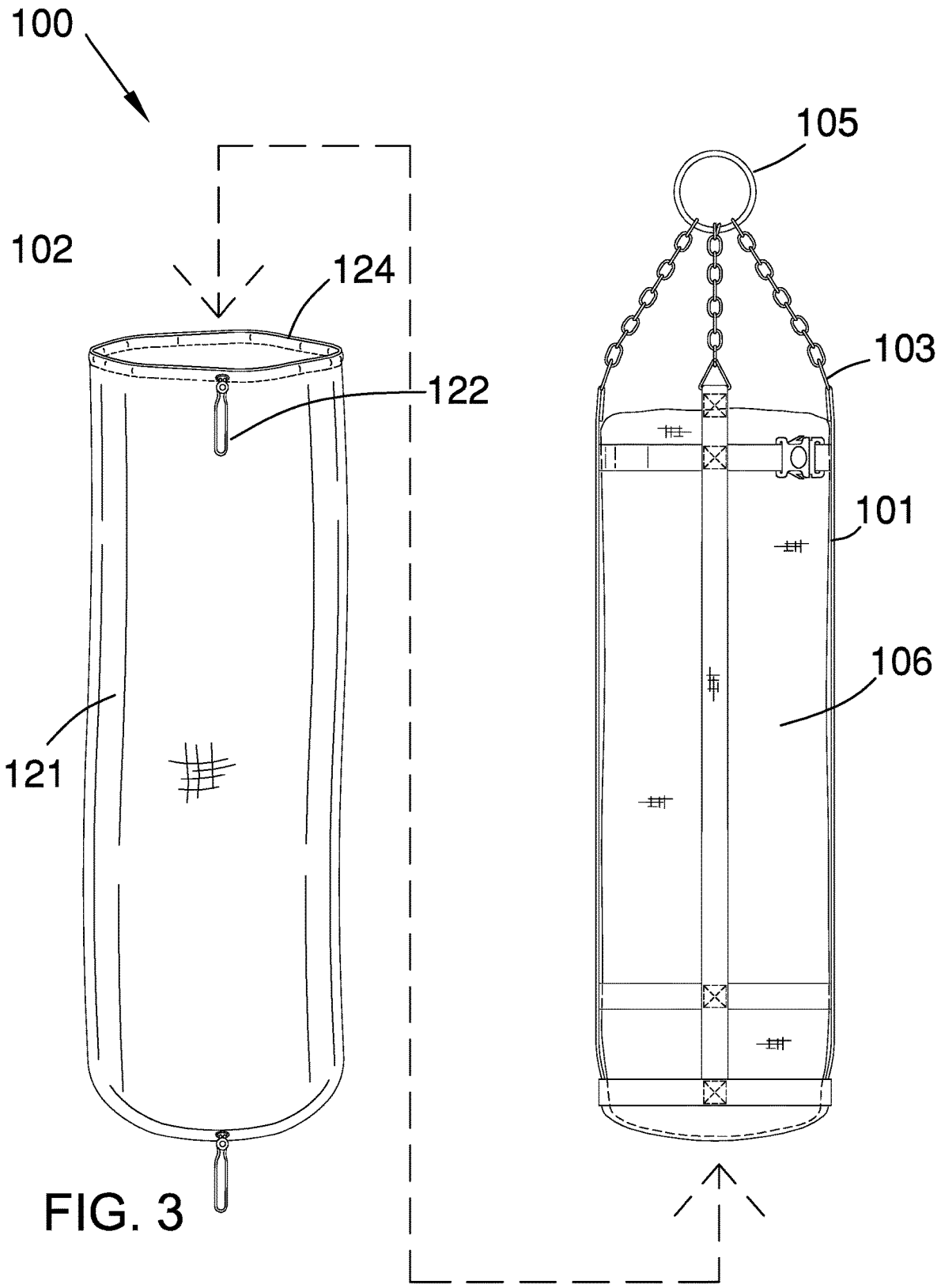
FIG. 3 is an exploded view of an embodiment of the disclosure.
Figure 4:
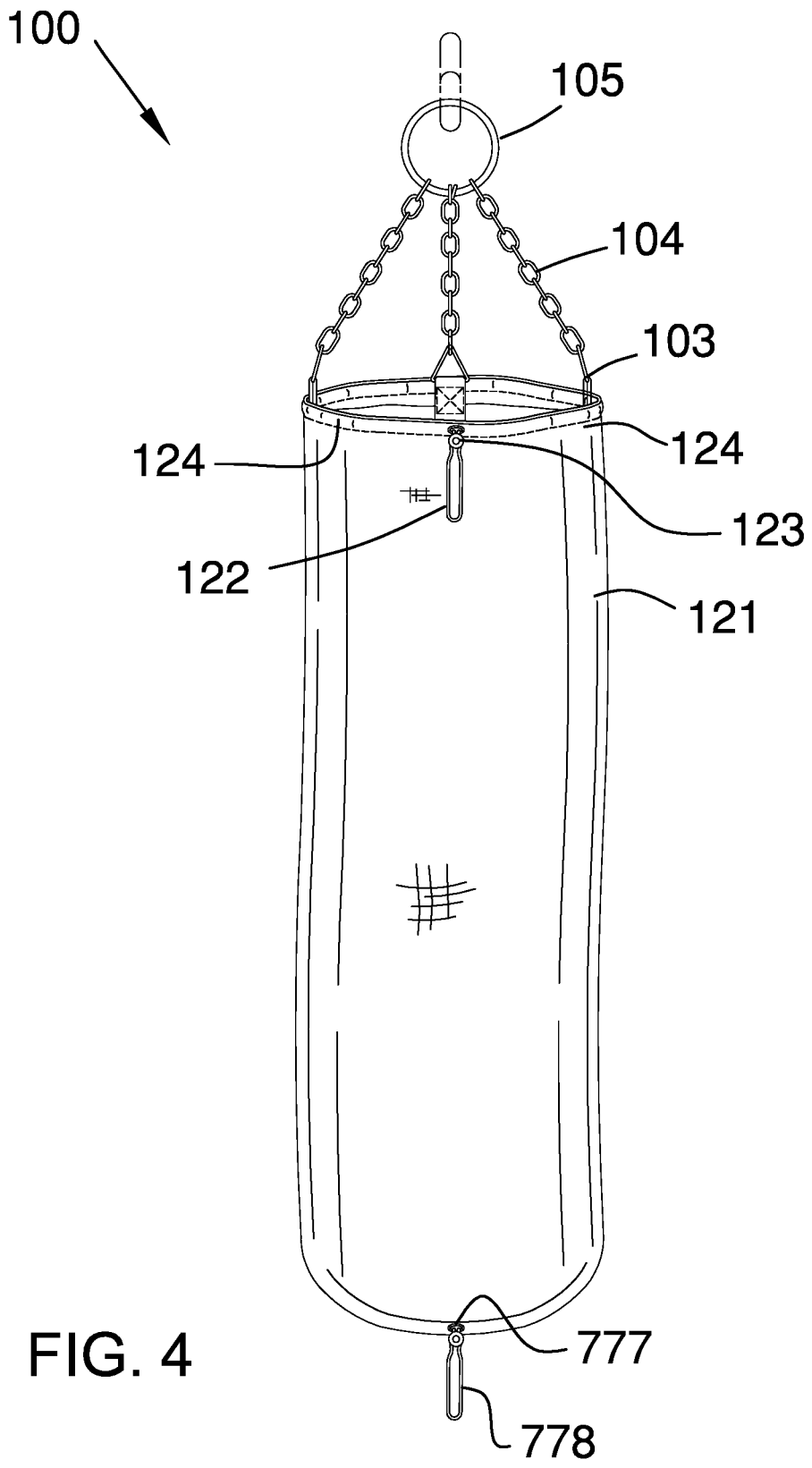
FIG. 4 is an in-use view of an embodiment of the disclosure.
Figure 5:
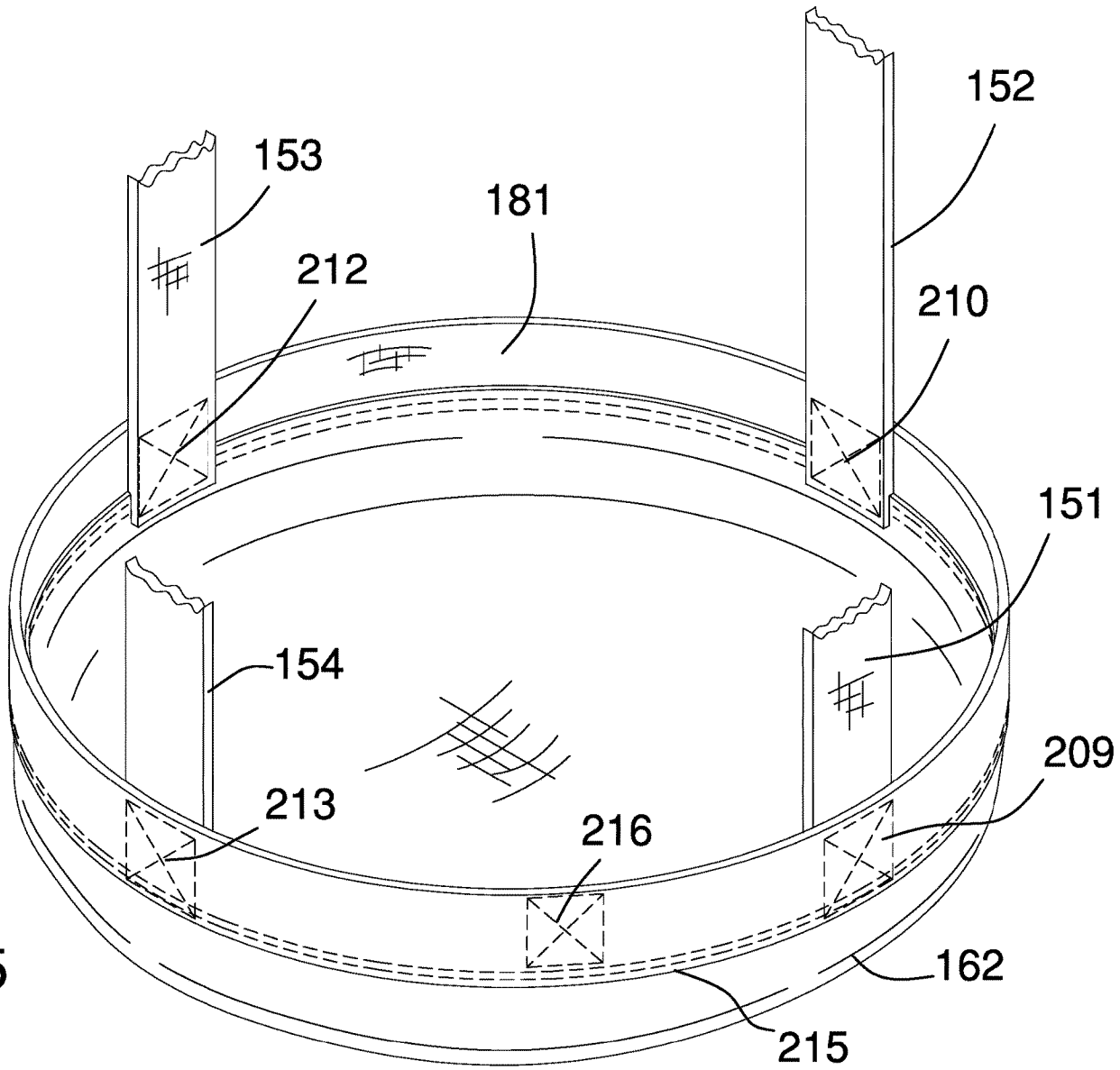
FIG. 5 is a detail view of an embodiment of the disclosure.
Figure 6:
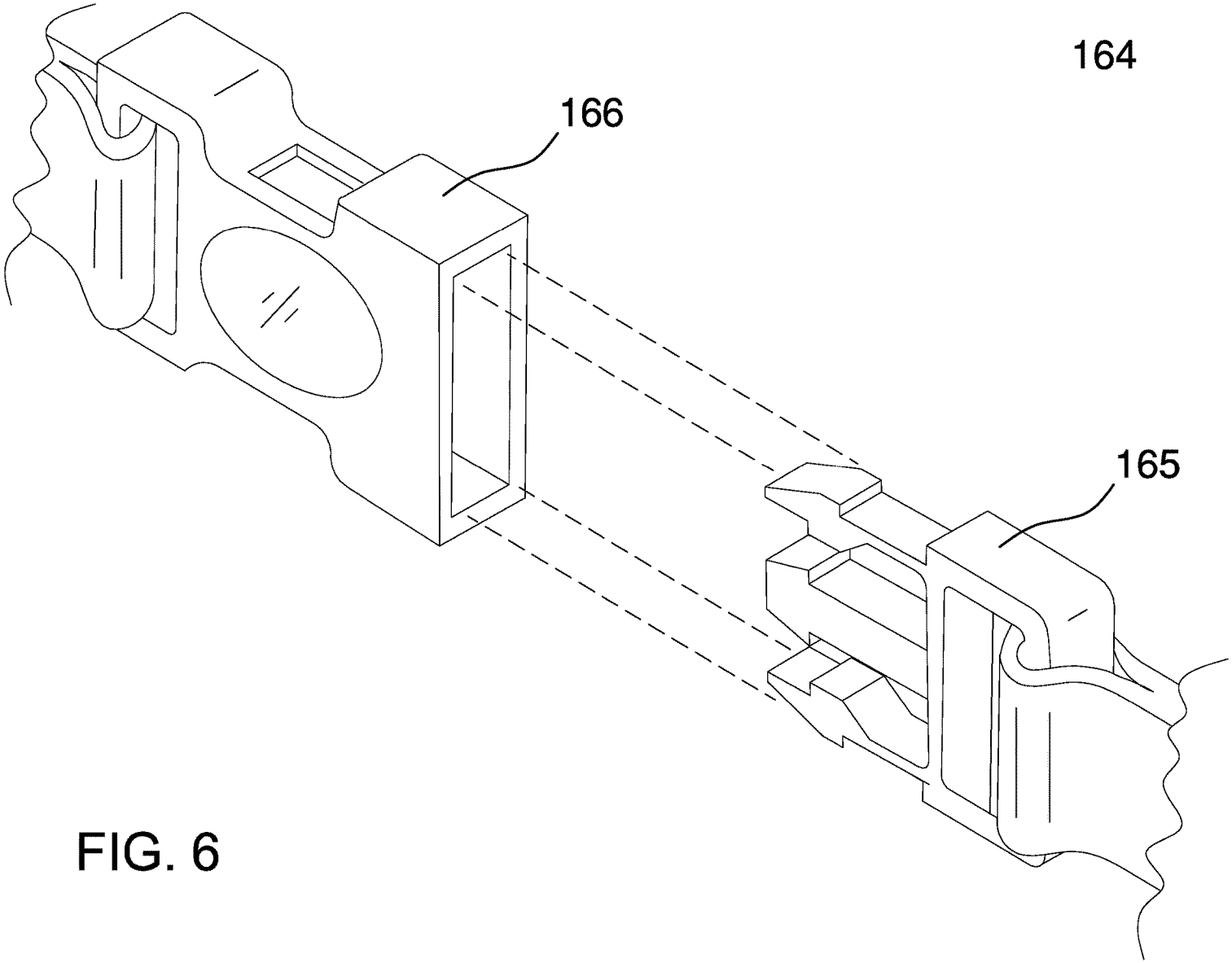
FIG. 6 is a detail view of an embodiment of the disclosure.
Figure 7:
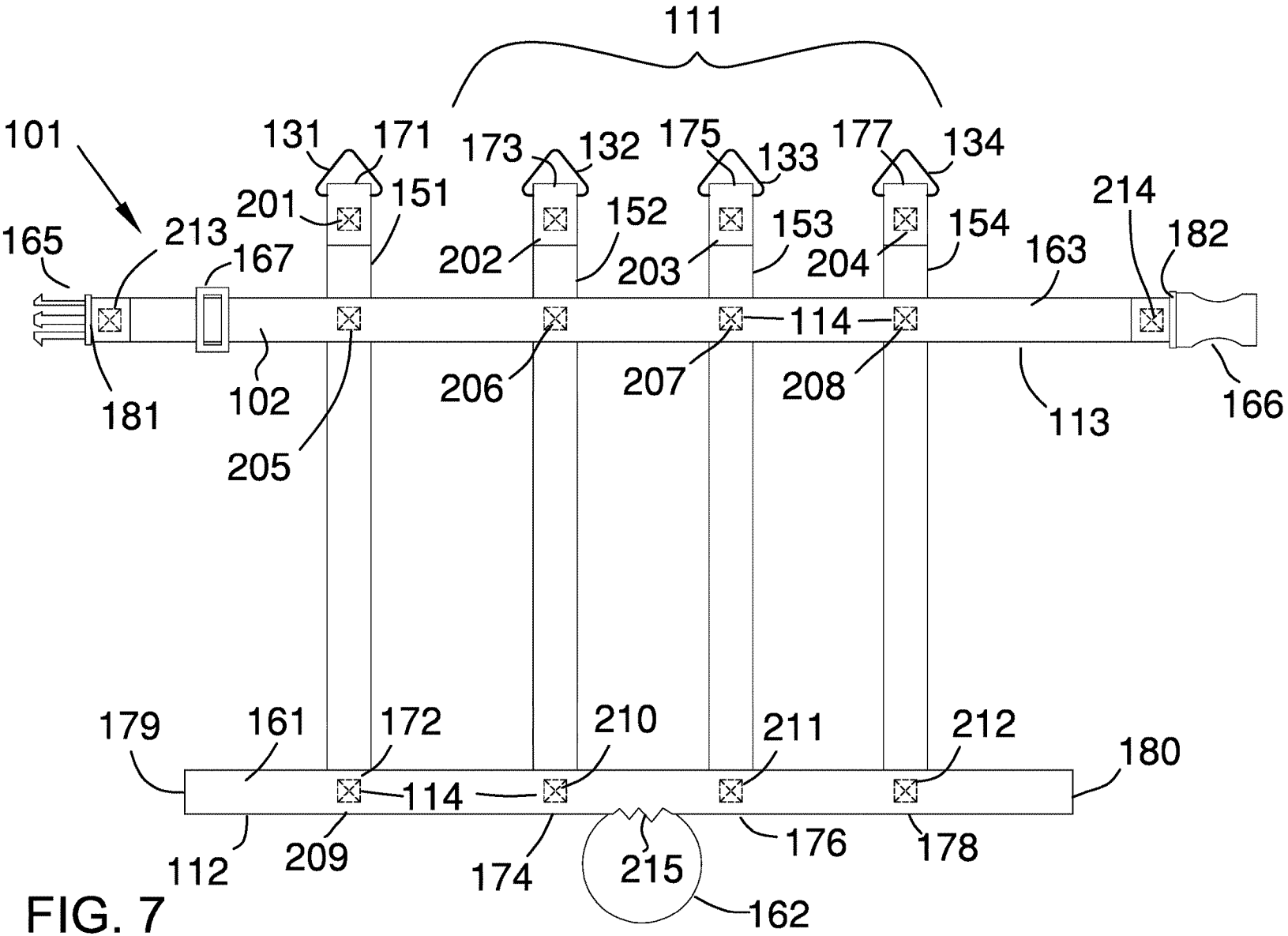
FIG. 7 is a detail view of an embodiment of the disclosure.

Detailed reference will now be made to one or more potential embodiments of the disclosure, which are illustrated in FIGS. 1 through 7.

The punching bag sling with cover 100 (hereinafter invention) is configured for use with a punching bag 106. The punching bag 106 is defined elsewhere in this disclosure. The invention 100 is a mechanical structure. The invention 100 suspends the punching bag 106 above a supporting surface. The invention 100 forms a sheath that encloses the punching bag 106. The invention 100 comprises a sling 101, a bag sheath 102, a plurality of anchor structures 103, a plurality of chains 104 and a suspension ring 105. The plurality of chains 104 attach the suspension ring 105 to the plurality of anchor structures 103. The plurality of anchor structures 103 attach the plurality of chains 104 to the sling 101. The bag sheath 102 forms the cover that encloses the punching bag 106. The suspension ring 105 forms an anchor point that suspends the invention 100 and the punching bag 106 above the supporting surface.

The sling 101 is a textile based structure. The sling 101 is a mechanical structure. The sling 101 attaches to the punching bag 106. The sling 101 is a harness that suspends the punching bag 106 above a supporting surface. The sling 101 comprises a plurality of straps 111, an inferior belt 112, a superior belt 113, and a plurality of seams 114. The plurality of seams 114 interconnects the plurality of straps 111, the inferior belt 112, and the superior belt 113 to form the harness structure of the sling 101.

Each of the plurality of straps 111 is a webbing. Each of the plurality of straps 111 is a vertically oriented structure that forms a load path that transfers the load of the punching bag 106 to the plurality of anchor structures 103, the plurality of chains 104, and the suspension ring 105. The plurality of straps 111 comprises a first strap 151, a second strap 152, a third strap 153, and a fourth strap 154. The first strap 151 further comprises a first end 171 and a second end 172. The second strap 152 further comprises a third end 173 and a fourth end 174. The third strap 153 further comprises a fifth end 175 and a sixth end 176. The fourth strap 154 further comprises a seventh end 177 and an eighth end 178.

The first strap 151 is a webbing that forms a portion to the load path between the inferior belt 112 and the superior belt 113 to the suspension ring 105. The second strap 152 is a webbing that forms a portion to the load path between the inferior belt 112 and the superior belt 113 to the suspension ring 105. The third strap 153 is a webbing that forms a portion to the load path between the inferior belt 112 and the superior belt 113 to the suspension ring 105. The fourth strap 154 is a webbing that forms a portion to the load path between the inferior belt 112 and the superior belt 113 to the suspension ring 105.

The inferior belt 112 is a webbing. The inferior belt 112 wraps around the vertically oriented face of the punching bag 106 such that the inferior belt 112 binds the sling 101 to the punching bag 106. The inferior belt 112 comprises an inferior strap 161 and an inferior panel 162. The inferior strap 161 further comprises a ninth end 179 and a tenth end 180.

The inferior strap 161 is a webbing. The inferior strap 161 wraps around the vertically oriented face of the punching bag 106 such that the inferior strap 161 secures the sling 101 to the punching bag 106. The inferior panel 162 is a textile based structure that attaches to the inferior strap 161. The inferior panel 162 attaches to the inferior strap 161 such that the inferior panel 162 forms a supporting surface on which the punching bag 106 rests when the punching bag 106 is suspended from the suspension ring 105 by the sling 101.

The superior belt 113 is a webbing. The superior belt 113 wraps around the vertically oriented face of the punching bag 106 such that the superior belt 113 binds the sling 101 to the punching bag 106. The superior belt 113 is an adjustable structure such that the tension applied to the punching bag 106 by the superior belt 113 is adjustable. The superior belt 113 comprises a superior strap 163, a quick release buckle 164, and a ring and slider arrangement 167. The superior strap 163 further comprises an eleventh end 181 and a twelfth end 182.

The superior strap 163 is a webbing. The superior strap 163 wraps around the vertically oriented face of the punching bag 106 such that the superior strap 163 secures the sling 101 to the punching bag 106.

The quick release buckle 164 is a fastening structure. The quick release buckle 164 forms a buckle that attaches the eleventh end 181 of the superior strap 163 to the twelfth end 182 of the superior strap 163. The quick release buckle 164 secures the superior strap 163 to the vertically oriented face of the punching bag 106. The quick release buckle 164 comprises a male connector 165 and a female connector 166. The quick release buckle 164 is defined elsewhere in this disclosure.

The male connector 165 is a first connector of the quick release buckle 164 that attaches to the superior strap 163. The female connector 166 is a second connector of the quick release buckle 164 that attaches to the superior strap 163. The male connector 165 is the structure of the quick release buckle 164 that inserts into the female connector 166 to secure the superior strap 163 to the punching bag 106.

The ring and slider arrangement 167 is a mechanical structure that attaches to the superior strap 163. The ring and slider arrangement 167 adjusts the span of the length of the superior strap 163 as the superior strap 163 attaches to the punching bag 106. The ring and slider arrangement 167 is defined elsewhere in this disclosure.

Each of the plurality of seams 114 is a sewn seam used to interconnect the plurality of straps 111, the inferior belt 112, and the superior belt 113 to form the sling 101. The plurality of seams 114 comprises a first seam 201, a second seam 202, a third seam 203, a fourth seam 204, a fifth seam 205, a sixth seam 206, a seventh seam 207, an eighth seam 208, a ninth seam 209, a tenth seam 210, an eleventh seam 211, and a twelfth seam 212.

The following four paragraphs describe the assembly of the invention 100.

The first seam 201 attaches the first anchor ring 131 to the first end 171 of the first strap 151. The second seam 202 attaches the second anchor ring 132 to the third end 173 of the second strap 152. The third seam 203 attaches the third anchor ring 133 to the fifth end 175 of the third strap 153. The fourth seam 204 attaches the fourth anchor ring 134 to the seventh end 177 of the fourth strap 154.

The fifth seam 205 attaches the face of the first strap 151 to the face of the superior strap 163 of the superior belt 113. The sixth seam 206 attaches the face of the second strap 152 to the face of the superior strap 163 of the superior belt 113. The seventh seam 207 attaches the face of the third strap 153 to the face of the superior strap 163 of the superior belt 113. The eighth seam 208 attaches the face of the fourth strap 154 to the face of the superior strap 163 of the superior belt 113.

The ninth seam 209 attaches the face of the second end 172 of the first strap 151 to the inferior strap 161 of the inferior belt 112. The tenth seam 210 attaches the face of the fourth end 174 of the second strap 152 to the inferior strap 161 of the inferior belt 112. The eleventh seam 211 attaches the face of the sixth end 176 of the third strap 153 to the inferior strap 161 of the inferior belt 112. The twelfth seam 212 attaches the face of the eighth end 178 of the fourth strap 154 to the inferior strap 161 of the inferior belt 112.

The thirteenth seam 213 attaches the male connector 165 of the quick release buckle 164 to the eleventh end 181 of the superior strap 163. The fourteenth seam 214 attaches the female connector 166 of the quick release buckle 164 to the twelfth end 182 of the superior strap 163. The fifteenth seam 215 attaches the inferior panel 162 to the inferior edge of the inferior strap 161. The sixteenth seam 216 attaches the ninth end 179 of the inferior strap 161 to the tenth end 180 of the inferior strap 161.

The bag sheath 102 is a containment structure. The bag sheath 102 is a sheath that encloses the sling 101 and the punching bag 106 after the sling 101 attaches to the punching bag 106. The bag sheath 102 protects the sling 101 and the punching bag 106 from damage during use of the punching bag 106. The bag sheath 102 comprises a bag sleeve 121, a drawstring 122, a drawstring 122 fastener 123, and a rouleau 124.

The bag sleeve 121 is a bag. The bag sleeve 121 is sized such that the punching bag 106 and the attached sling 101 can be stored within the bag sleeve 121. The bag sleeve 121 forms a sacrificial surface around the punching bag 106 that protects the punching bag 106 from damage during use of the punching bag 106.

The drawstring 122 is a cord. The drawstring 122 cinches the bag sleeve 121 into a closed position such that the drawstring 122 secures the bag sleeve 121 to the punching bag 106.

The drawstring 122 fastener 123 is a fastening structure. The drawstring 122 fastener 123 is selected from the group consisting of a knot and a cord lock. The knot and the cord lock are defined elsewhere in this disclosure. The drawstring 122 fastener 123 secures the drawstring 122 to itself such that the drawstring 122 cinches the bag sleeve 121 to the punching bag 106.

The rouleau 124 is a channel formed in the bag sleeve 121 of the bag sheath 102. The rouleau 124 is formed around the opening of the bag sleeve 121. In the first potential embodiment of the disclosure, a "quick cord" is used to create the rouleau 124 and the drawstring 122 of the bag sheath 102.

The bag sleeve 121 may be further defined with a bottom opening 777. The bottom opening 777 may include a second drawstring 778 so as to close off the bottom opening 777 thereby enclosing a bottom portion 779 of the punching bag 106. Since the bag sleeve 121 has a bottom opening 777 along with the rouleau 124, the bag sleeve 121 may be further defined as a cylinder.

Each of the plurality of anchor structures 103 is a ring structure. Each of the plurality of anchor structures 103 attaches to the sling 101. Each of the plurality of anchor structures 103 forms an anchor point on the sling 101. The plurality of anchor structures 103 comprises a first anchor ring 131, a second anchor ring 132, a third anchor ring 133, and a fourth anchor ring 134.

The first anchor ring 131 is a ring structure that forms a loop. The first anchor ring 131 attaches to the first strap 151. The first anchor ring 131 forms an anchor point that allows a chain selected from the plurality of chains 104 to attach the sling 101 to the suspension ring 105.

The second anchor ring 132 is a ring structure that forms a loop. The second anchor ring 132 attaches to the second strap 152. The second anchor ring 132 forms an anchor point that allows a chain selected from the plurality of chains 104 to attach the sling 101 to the suspension ring 105.

The third anchor ring 133 is a ring structure that forms a loop. The third anchor ring 133 attaches to the third strap 153. The third anchor ring 133 forms an anchor point that allows a chain selected from the plurality of chains 104 to attach the sling 101 to the suspension ring 105.

The fourth anchor ring 134 is a ring structure that forms a loop. The fourth anchor ring 134 attaches to the fourth strap 154. The fourth anchor ring 134 forms an anchor point that allows a chain selected from the plurality of chains 104 to attach the sling 101 to the suspension ring 105.

Each of the plurality of chains 104 is a chain that attaches an anchor structure selected from the plurality of anchor structures 103 to the suspension ring 105. The plurality of chains 104 suspend the sling 101 and the punching bag 106 from the suspension ring 105. The plurality of chains 104 comprises a first chain 141, a second chain 142, a third chain 143, and a fourth chain 144.

The first chain 141 attaches the first anchor ring 131 to the suspension ring 105. The second chain 142 attaches the second anchor ring 132 to the suspension ring 105. The third chain 143 attaches the third anchor ring 133 to the suspension ring 105. The fourth chain 144 attaches the fourth anchor ring 134 to the suspension ring 105.

The suspension ring 105 is a ring structure. The suspension ring 105 attaches to an elevated structure such that the suspension ring 105 forms the final link of the load path that suspends the sling 101 and the punching bag 106 from the elevated structure. The plurality of chains 104 attaches the plurality of anchor structures 103 to the suspension ring 105 such that the suspension ring 105 suspends the sling 101 and the punching bag 106.

The following definitions were used in this disclosure:

Bag: As used in this disclosure, a bag is a container made of a flexible material. The bag has a single opening which allows the bag to receive the items to be contained.

Band: As used in this disclosure, a band is a flat loop of material.

Belt: As used in this disclosure, a belt is a strip of flexible material that wraps around the lateral face of a prism-shaped object.

Bind: As used in this disclosure, to bind is a verb that means to tie or secure a first object to a second object by wrapping a third object around the first object and the second object.

Buckle: As used in this disclosure, a buckle is a fastening device that is used for joining a first loose end of a strap to a second loose end of the same strap or a different strap. A buckle further comprises a male connector that is attached to a first loose end and a female connector that is attached to a second loose end. The male connector has a pin or other structure that is generally caught by a structure formed in the female connector.

Chain: As used in this disclosure, a chain is a series of interlinked rings that form a cord-like structure. Like a cord, a chain has tensile strength but is too flexible to provide compressive strength and is not suitable for use in pushing objects. The rings to form a chain are often formed from a metal.

Channel: As used in this disclosure, a channel is a tubular passage through which an object or fluid is passed through.

Cord: As used in this disclosure, a cord is a long, thin, flexible, and prism shaped string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, and rope are synonyms for cord.

Cord Lock: As used in this disclosure, a cord lock is a device that is used to tighten cords or drawstrings without the use of knots.

Drawstring: As used in this disclosure, a drawstring is a cord, tape, or a webbing that is contained within a channel that is used to fasten or cinch a textile based object such as an item of apparel of a textile covering. Generally, the channel and cord are formed as a single textile component (in the form of a tape that is often marketed commercially "Quick Cord") that is sewn as a single unit into the textile based object after which the cord is released within the channel.

Force of Gravity: As used in this disclosure, the force of gravity refers to a vector that indicates the direction of the pull of gravity on an object at or near the surface of the earth.

Harness: As used in this disclosure, a harness is an apparatus comprising a plurality of straps and one or more fasteners that is used to fasten or anchor a first person or first object to a second object. The phrase N point harness refers to the installation of the harness wherein the harness has N anchor points. For example, a 2 point harness has two anchor points while a 5 point harness has 5 anchor points.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Knot: As used in this disclosure, a knot is an interlacement of cord, ribbon, rope, or similar materials that is used to: 1) secure the cord, ribbon, rope, or other similar material to an object which may include, but is not limited to, a second cord, ribbon, rope, or other similar material; or, 2) prevent the cord, ribbon, rope, or other similar material from being pulled through a hole or out of a retaining device. In this disclosure, the second type of knot is referred to as a stopper knot.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Loop: As used in this disclosure, a loop is the length of a first linear structure including, but not limited to, shafts, lines, cords, or webbings, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Punching Bags and Speed Bags: As used in this disclosure, a punching bag or a speed bag is a structure that is suspended above the ground. The punching bag or speed bag is designed to receive punches and other blows from exercisers for physical training purposes, especially for combat sports such as boxing or mixed martial arts. Punching bags differentiated from speed bags by form and weight. Traditionally a punching bag is cylindrically shaped and significantly larger and heavier than a speed bag. A speed bag is traditionally spherically or pear shaped.

Quick Release Buckle: As used in this disclosure, a quick release buckle is a specific type of buckle wherein the buckle can be readily and easily disconnected by pressing a button or pinching one of the ends of the quick release buckle. Quick release buckles are readily and commercially available.

Ring: As used in this disclosure, a ring is term that is used to describe a disk-like structure through which an aperture is formed. Rings are often considered loops.

Ring and Slider Arrangement: As used in this disclosure, a ring and slider arrangement is an apparatus comprising a ring component and a slider component that is used to adjust the effective length of a webbing in an application. In the ring and slider arrangement, an end of the webbing is inserted through the slider component, looped through the ring component and then reverse threaded through the slider component for a second time. By adjusting the position of the slider component relative to the webbing, the effective length of the webbing can be adjusted. Ring and slider arrangements are well known and documented in the textile arts.

Rouleau: As used in this disclosure, a rouleau is a tube or channel that is formed on the edge of a textile or sheeting.

Sacrificial Material: As used in this disclosure, a sacrificial material is a material that protects a first object or structure from damage. More specifically, the sacrificial material protects the second object or structure by being damaged during use of the second object or structure.

Seam: As used in this disclosure, a seam is a joining of: 1) a first textile to a second textile; 2) a first sheeting to a second sheeting; or, 3) a first textile to a first sheeting. Potential methods to form seams include, but are not limited to, a sewn seam, a heat bonded seam, an ultrasonically bonded seam, a laser seam, or a seam formed using an adhesive.

Sewn Seam: As used in this disclosure, a sewn seam a method of attaching two or more layers of textile, leather, or other material through the use of a thread, a yarn, or a cord that is repeatedly inserted and looped through the two or more layers of textile, leather, or other material.

Sling: As used in this disclosure, a sling is a harness used to suspend an object.

Strap: As used in this disclosure a strap is a strip of leather, cloth, or other flexible material, often with a buckle, that is used to fasten, secure, carry, or hold onto something.

Strip: As used in this disclosure, the term describes a long and narrow object of uniform thickness that appears thin relative to the length of the object. Strips are often rectangular in shape.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Suspend: As used in this disclosure, to suspend an object means to support an object such that the inferior end of the object does not form a significant portion of the load path of the object. Include inferior superior and load path.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips. Webbings have tensile strength but are too flexible to provide compressive strength and are not suitable for use in pushing objects. The two surfaces of a webbing with the greatest surface area are called the faces of the webbing.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An accessory for a punching bag comprising a sling, a bag sheath, a plurality of anchor structures, a plurality of chains and a suspension ring;

wherein the plurality of chains attach the suspension ring to the plurality of anchor structures;

wherein the plurality of anchor structures attach the plurality of chains to the sling;

wherein the suspension ring forms an anchor point that suspends the accessory and the punching bag above a supporting surface;

wherein the bag sheath is configured for use with a punching bag;

wherein the accessory suspends the punching bag above the supporting surface;

wherein the accessory forms a sheath that encloses the punching bag;

wherein the bag sheath forms a cover that encloses the punching bag;

wherein the sling is a textile based structure;

wherein the sling is a mechanical structure;

wherein the sling attaches to the punching bag;

wherein the sling is a harness that suspends the punching bag above the supporting surface.

2. The accessory for the punching bag according to claim 1 wherein the bag sheath is a containment structure;

wherein the bag sheath is a sheath that encloses the sling and the punching bag after the sling attaches to the punching bag;

wherein the bag sheath protects the sling and the punching bag from damage during use of the punching bag.

3. The accessory for the punching bag according to claim 2 wherein each of the plurality of anchor structures is a ring structure;

wherein each of the plurality of anchor structures attaches to the sling;

wherein each of the plurality of anchor structures forms an anchor point on the sling.

4. The accessory for the punching bag according to claim 3 wherein each of the plurality of chains is a chain that attaches an anchor structure selected from the plurality of anchor structures to the suspension ring;

wherein the plurality of chains suspend the sling and the punching bag from the suspension ring.

5. The accessory for the punching bag according to claim 4 wherein the suspension ring is a ring structure;

wherein the plurality of chains attaches the plurality of anchor structures to the suspension ring such that the suspension ring suspends the sling and the punching bag.

6. The accessory for the punching bag according to claim 5 wherein the sling comprises a plurality of straps, an inferior belt, a superior belt, and a plurality of seams;

wherein the plurality of seams interconnects the plurality of straps, the inferior belt, and the superior belt to form the harness structure of the sling.

7. The accessory for the punching bag according to claim 6 wherein the bag sheath comprises a bag sleeve, a drawstring, a drawstring fastener, and a rouleau;

wherein the bag sleeve is a bag;

wherein the drawstring is a cord;

wherein the rouleau is a channel formed in the bag sleeve of the bag sheath;

wherein the drawstring fastener is a fastening structure;

wherein the bag sleeve is further defined with a bottom opening;

wherein the bottom opening include a second drawstring that is used to close off the bottom opening thereby enclosing a bottom portion of the punching bag.

8. The accessory for the punching bag according to claim 7 wherein each of the plurality of straps is a webbing;

wherein each of the plurality of straps is a vertically oriented structure that forms a load path that transfers the load of the punching bag to the plurality of anchor structures, the plurality of chains, and the suspension ring.

9. The accessory for the punching bag according to claim 8 wherein the inferior belt is a webbing;

wherein the inferior belt wraps around the vertically oriented face of the punching bag such that the inferior belt binds the sling to the punching bag.

10. The accessory for the punching bag according to claim 9 wherein the superior belt is a webbing;

wherein the superior belt wraps around the vertically oriented face of the punching bag such that the superior belt binds the sling to the punching bag;

wherein the superior belt is an adjustable structure such that the tension applied to the punching bag by the superior belt is adjustable.

11. The accessory for the punching bag according to claim 10 wherein the plurality of straps comprises a first strap, a second strap, a third strap, and a fourth strap;

wherein the first strap further comprises a first end and a second end;

wherein the second strap further comprises a third end and a fourth end;

wherein the third strap further comprises a fifth end and a sixth end;

wherein the fourth strap further comprises a seventh end and an eighth end;

wherein the first strap is a webbing that forms a portion to the load path between the inferior belt and the superior belt to the suspension ring;

wherein the second strap is a webbing that forms a portion to the load path between the inferior belt and the superior belt to the suspension ring;

wherein the third strap is a webbing that forms a portion to the load path between the inferior belt and the superior belt to the suspension ring;

wherein the fourth strap is a webbing that forms a portion to the load path between the inferior belt and the superior belt to the suspension ring.

12. The accessory for the punching bag according to claim 11 wherein the inferior belt comprises an inferior strap and an inferior panel;

wherein the inferior strap further comprises a ninth end and a tenth end;

wherein the inferior strap is a webbing;

wherein the inferior strap wraps around the vertically oriented face of the punching bag such that the inferior strap secures the sling to the punching bag;

wherein the inferior panel is a textile based structure that attaches to the inferior strap;

wherein the inferior panel attaches to the inferior strap such that the inferior panel forms a supporting surface on which the punching bag rests when the punching bag is suspended from the suspension ring by the sling.

13. The accessory for the punching bag according to claim 12 wherein the superior belt comprises a superior strap, a quick release buckle, and a ring and slider arrangement;

wherein the superior strap further comprises an eleventh end and a twelfth end;

wherein the superior strap is a webbing;

wherein the superior strap wraps around the vertically oriented face of the punching bag such that the superior strap secures the sling to the punching bag;

wherein the quick release buckle is a fastening structure;

wherein the quick release buckle forms a buckle that attaches the eleventh end of the superior strap to the twelfth end of the superior strap;

wherein the quick release buckle secures the superior strap to the vertically oriented face of the punching bag.

14. The accessory for the punching bag according to claim 13 wherein the ring and slider arrangement is a mechanical structure that attaches to the superior strap;

wherein the ring and slider arrangement adjusts the span of the length of the superior strap as the superior strap attaches to the punching bag.

15. The accessory for the punching bag according to claim 14 wherein the quick release buckle comprises a male connector and a female connector;

wherein the male connector is a first connector of the quick release buckle that attaches to the superior strap;

wherein the female connector is a second connector of the quick release buckle that attaches to the superior strap;

wherein the male connector is the structure of the quick release buckle that inserts into the female connector to secure the superior strap to the punching bag.

16. The accessory for the punching bag according to claim 15 wherein each of the plurality of seams is a sewn seam used to interconnect the plurality of straps, the inferior belt, and the superior belt to form the sling.

17. The accessory for the punching bag according to claim 16 wherein the bag sleeve is sized such that the punching bag and the attached sling are stored within the bag sleeve;

wherein the bag sleeve forms a sacrificial surface around the punching bag that protects the punching bag from damage during use of the punching bag;

wherein the drawstring cinches the bag sleeve into a closed position such that the drawstring secures the bag sleeve to the punching bag;

wherein the drawstring fastener is selected from the group consisting of a knot and a cord lock;

wherein the drawstring fastener secures the drawstring to itself such that the drawstring cinches the bag sleeve to the punching bag;

wherein the rouleau is formed around the opening of the bag sleeve.

18. The accessory for the punching bag according to claim 17 wherein the plurality of anchor structures comprises a first anchor ring, a second anchor ring, a third anchor ring, and a fourth anchor ring;

wherein the first anchor ring is a ring structure that forms a loop;

wherein the first anchor ring attaches to the first strap;

wherein the first anchor ring forms an anchor point that allows a chain selected from the plurality of chains to attach the sling to the suspension ring;

wherein the second anchor ring is a ring structure that forms a loop;

wherein the second anchor ring attaches to the second strap;

wherein the second anchor ring forms an anchor point that allows a chain selected from the plurality of chains to attach the sling to the suspension ring;

wherein the third anchor ring is a ring structure that forms a loop;

wherein the third anchor ring attaches to the third strap;

wherein the third anchor ring forms an anchor point that allows a chain selected from the plurality of chains to attach the sling to the suspension ring;

wherein the fourth anchor ring is a ring structure that forms a loop;

wherein the fourth anchor ring attaches to the fourth strap;

wherein the fourth anchor ring forms an anchor point that allows a chain selected from the plurality of chains to attach the sling to the suspension ring;

wherein the plurality of chains comprises a first chain, a second chain, a third chain, and a fourth chain;

wherein the first chain attaches the first anchor ring to the suspension ring;

wherein the second chain attaches the second anchor ring to the suspension ring;

wherein the third chain attaches the third anchor ring to the suspension ring;

wherein the fourth chain attaches the fourth anchor ring to the suspension ring.

19. The accessory for the punching bag according to claim 18 wherein the plurality of seams comprises a first seam, a second seam, a third seam, a fourth seam, a fifth seam, a sixth seam, a seventh seam, an eighth seam, a ninth seam, a tenth seam, an eleventh seam, and a twelfth seam;

wherein the first seam attaches the first anchor ring to the first end of the first strap;

wherein the second seam attaches the second anchor ring to the third end of the second strap;

wherein the third seam attaches the third anchor ring to the fifth end of the third strap;

wherein the fourth seam attaches the fourth anchor ring to the seventh end of the fourth strap;

wherein the fifth seam attaches the face of the first strap to the face of the superior strap of the superior belt;

wherein the sixth seam attaches the face of the second strap to the face of the superior strap of the superior belt;

wherein the seventh seam attaches the face of the third strap to the face of the superior strap of the superior belt;

wherein the eighth seam attaches the face of the fourth strap to the face of the superior strap of the superior belt;

wherein the ninth seam attaches the face of the second end of the first strap to the inferior strap of the inferior belt;

wherein the tenth seam attaches the face of the fourth end of the second strap to the inferior strap of the inferior belt;

wherein the eleventh seam attaches the face of the sixth end of the third strap to the inferior strap of the inferior belt;

wherein the twelfth seam attaches the face of the eighth end of the fourth strap to the inferior strap of the inferior belt;

wherein the thirteenth seam attaches the male connector of the quick release buckle to the eleventh end of the superior strap;

wherein the fourteenth seam attaches the female connector of the quick release buckle to the twelfth end of the superior strap;

wherein the fifteenth seam attaches the inferior panel to the inferior edge of the inferior strap;

wherein the sixteenth seam attaches the ninth end of the inferior strap to the tenth end of the inferior strap.

* * * * *